US005716088A

United States Patent [19]

Chander et al.

[11] Patent Number: 5,716,088

[45] Date of Patent: Feb. 10, 1998

[54] MULTIPLE USE TRUNNION CONNECTION FOR LIFT SPREADER

[75] Inventors: Prabhat Chander; David Michael Crimmins, both of Metairie, La.

[73] Assignee: J. Ray McDermott, S.A., New Orleans, La.

[21] Appl. No.: 756,840

[22] Filed: Nov. 26, 1996

[51] Int. Cl.[6] ..... B66C 1/12

[52] U.S. Cl. ..... 294/81.1; 294/81.3

[58] Field of Search ..... 294/81.1, 81.2, 294/81.21, 81.3, 81.5, 74, 82.11, 15, 26

[56] References Cited

U.S. PATENT DOCUMENTS

| | | | |
|---|---|---|---|
| 1,603,913 | 10/1926 | Gillitzer | 294/81.24 |
| 3,021,166 | 2/1962 | Kempel et al. | 294/81.21 |
| 3,831,993 | 8/1974 | Drayton et al. | 294/82.11 |
| 4,538,849 | 9/1985 | Khachaturian et al. | 294/81.1 |

FOREIGN PATENT DOCUMENTS

| | | | |
|---|---|---|---|
| 614-005 | 7/1978 | U.S.S.R. | 294/81.1 |
| 83/00855 | 3/1983 | WIPO | 294/81.1 |

*Primary Examiner*—Dean Kramer

*Attorney, Agent, or Firm*—Robert J. Edwards; D. Neil LaHaye

[57] ABSTRACT

A multiple use trunnion connection for use with a lifting spreader bar or frame. A trunnion connection is placed at each end of a lifting spreader that is sized for the particular lift. Each trunnion is provided with a set of horizontally and vertically disposed pins that are positioned to retain the lifting slings in place on the trunnion during the lift without the need for shackles and lifting eyes.

1 Claim, 4 Drawing Sheets

FIG. 5
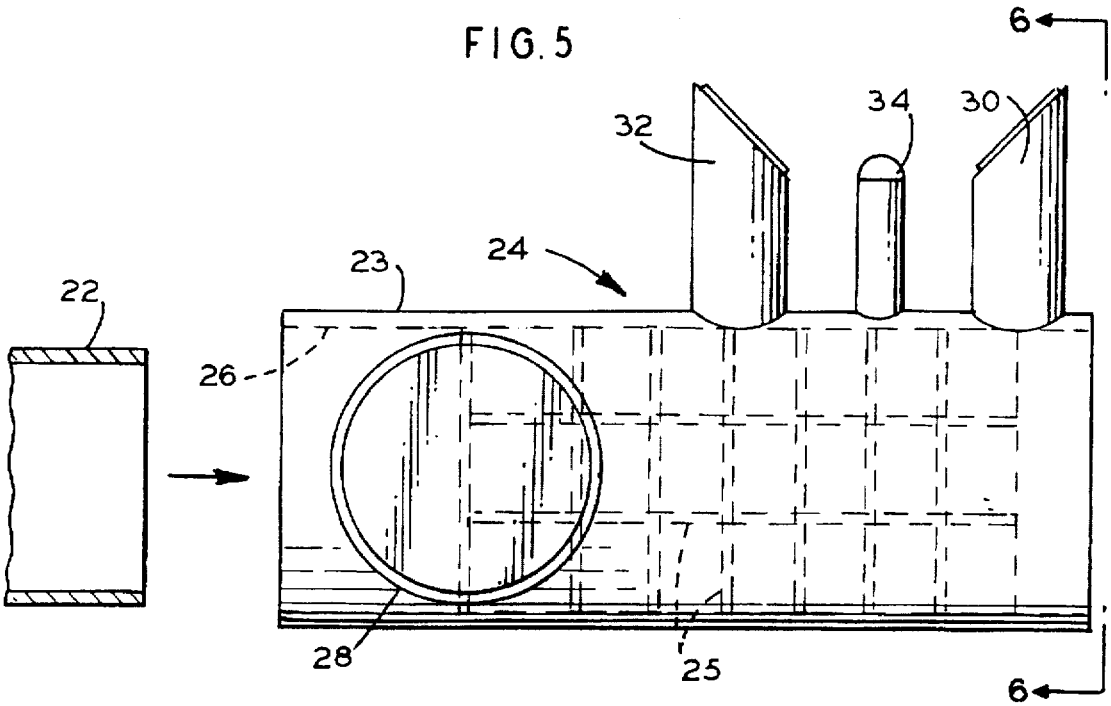
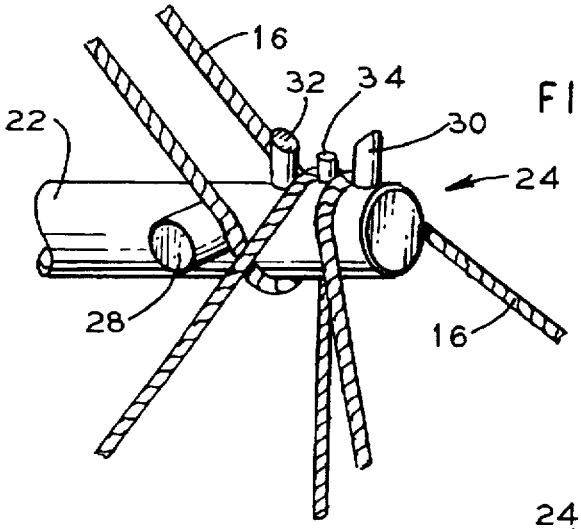
FIG. 4
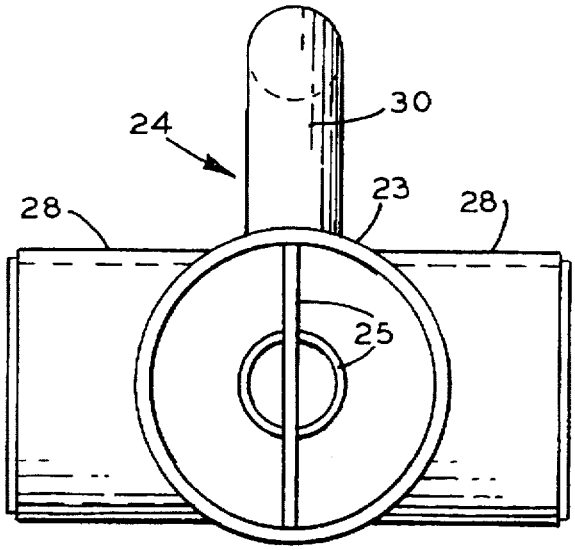
FIG. 6

MULTIPLE USE TRUNNION CONNECTION FOR LIFT SPREADER

BACKGROUND OF THE INVENTION

1. Field of the Invention

The invention is generally related to the lifting of large objects and more particularly to the use of a reusable trunnion end with a spreader bar or frame when lifting large objects.

2. General Background

Lifting large heavy objects is an integral part of every type of construction and is especially important in the marine construction industry. Lifts on the order of twenty-five short tons up to thousands of short tons are commonplace.

Spreader frames and bars are used extensively to avoid interference between the lifting slings and objects/equipment on the lifted item. However, due to the wide variance in the distance between lift points, the dimensions and lengths of these spreader bars and frames constantly change.

Lift appurtenances typically include slings, shackles, link plates and occasionally spreader bars or frames, depending on the item(s) being lifted. Conventional rigging that includes slings and shackles is reliable and adequate but also costly, heavy, and can be time consuming for rig up and dismantling. Conventional rigging is heavy and requires manual handling to rig up for lifts. Conventional rigging requires many loose pieces which need assembly normally by manual labor. Rig up can be time consuming when large numbers of pieces are required. Conventional rigging is expensive when specialized pieces are required to obtain required sling lengths for level lifts. Conventional rigging is not flexible when the location of centers of gravity are ill defined, thereby causing a shift in the angle of lifting slings. During rigging, the length of slings from the spreader to the lifting crane and from the spreader to the object being lifted must also be carefully matched for an even lift.

It can be seen that the present state of the art leaves a need for an improved spreader bar/frame used for lifts.

SUMMARY OF THE INVENTION

The invention addresses the above need. What is provided is a multiple use trunnion connection for use with a lifting spreader bar or frame. A trunnion connection is placed at each end of a lifting spreader that is sized for the particular lift. Each trunnion is provided with a set of horizontally and vertically disposed pins that are positioned to retain the lifting slings in place on the trunnion during the lift. Unlike shackles where the length of the slings are fixed, the slings are simply wrapped around the trunnion in the proper position around the pins. This allows the slings to adjust and slide over the trunnion if the center of gravity of the lift is off of the calculated position.

BRIEF DESCRIPTION OF THE DRAWINGS

For a further understanding of the nature and objects of the present invention reference should be made to the following description, taken in conjunction with the accompanying drawings in which like parts are given like reference numerals, and wherein:

FIG. 4 is an enlarged view of the invention on a spreader bar.

FIG. 5 is an elevation phantom view of the invention.

FIG. 6 is a view taken along lines 6—6 in FIG. 5.

DETAILED DESCRIPTION OF THE PREFERRED EMBODIMENT

Figure 1:
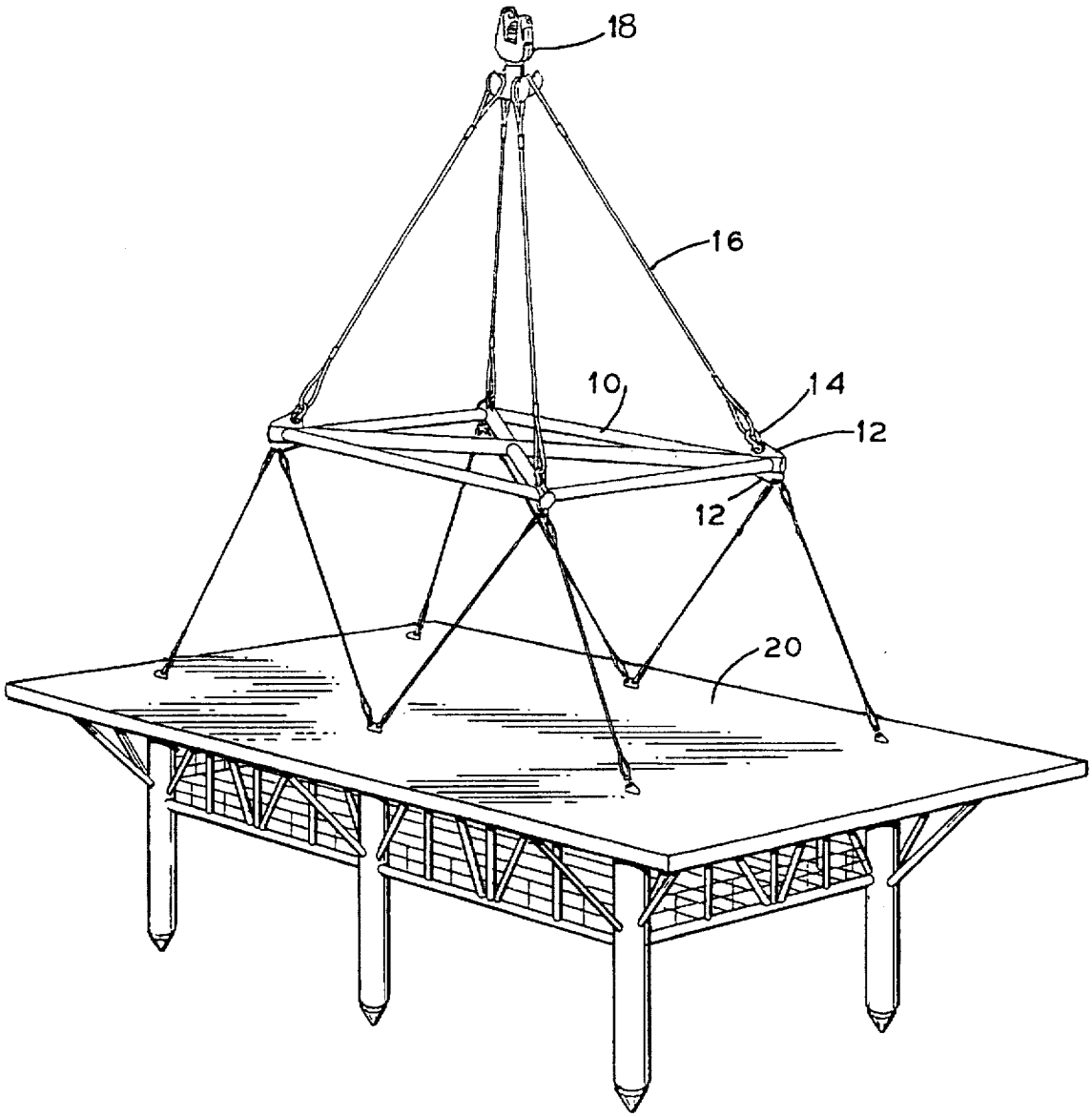
FIG. 1 illustrates a typical lift of an offshore structure using a spreader frame.

Referring to the drawings, FIG. 1 illustrates a typical lift of an offshore structure using a spreader frame 10 as typically rigged in the prior art. In the prior art rigging, the spreader frame 10 has an upper and lower lifting eye 12 at each corner that each receives a shackle 14. The shackles 14 each receive a loop in a sling 16. The slings attached to the upper lifting eyes have a loop at the opposite end received on a crane hook 18. The shackles 14 attached to the lower lifting eyes each receive a loop from a sling which in turn has the loop at the opposite end of the sling received by shackles on lifting eyes on the offshore deck unit 20. The spreader frame serves the purpose of spreading the force of the lift across a wider area of the offshore deck unit 20. Although no other equipment is shown on the offshore deck unit 20, the spreader frame also serves to avoid interference between the slings and equipment which may already be in place on the offshore deck unit 20.

Figure 2:
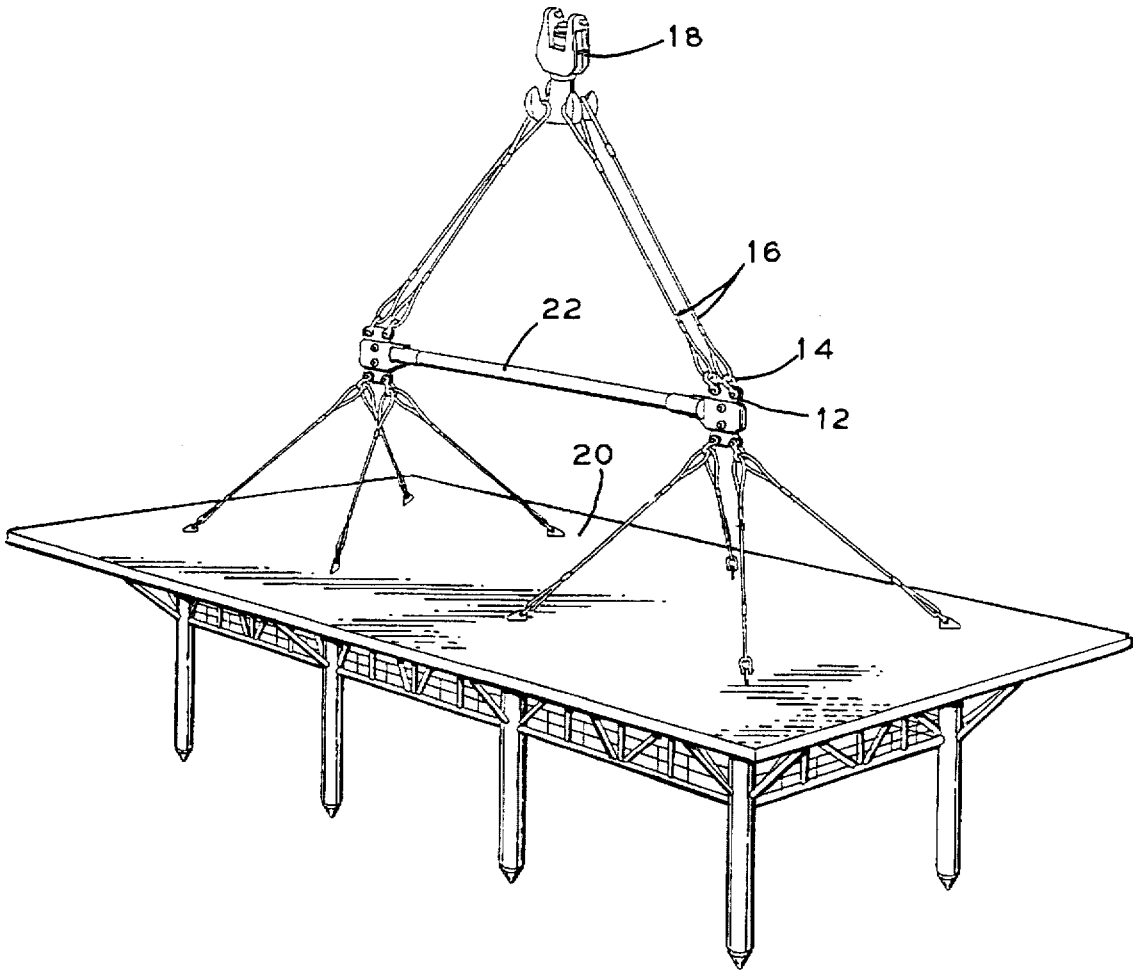
FIG. 2 illustrates a typical lift of an offshore structure using a spreader bar.

FIG. 2 illustrates a typical lift of an offshore structure using a spreader bar 22. It can be seen that the spreader bar 22 utilizes the same type of prior art rigging as the spreader frame 10 in FIG. 1.

The invention, illustrated in FIG. 3–6 and generally designated by numeral 24 comprises a trunnion for a lifting spreader device that provides for a less complicated and less expensive rigging than that used in the prior art. Trunnion 24 is formed from a tubular body 23 provided with suitable interior bracing 25 to provide support for the pressure encountered during a lift.

As best seen in FIG. 5, a first end of trunnion end 24 is provided with a bore 26 sized to closely receive the end of a spreader bar 22.

Figure 3:
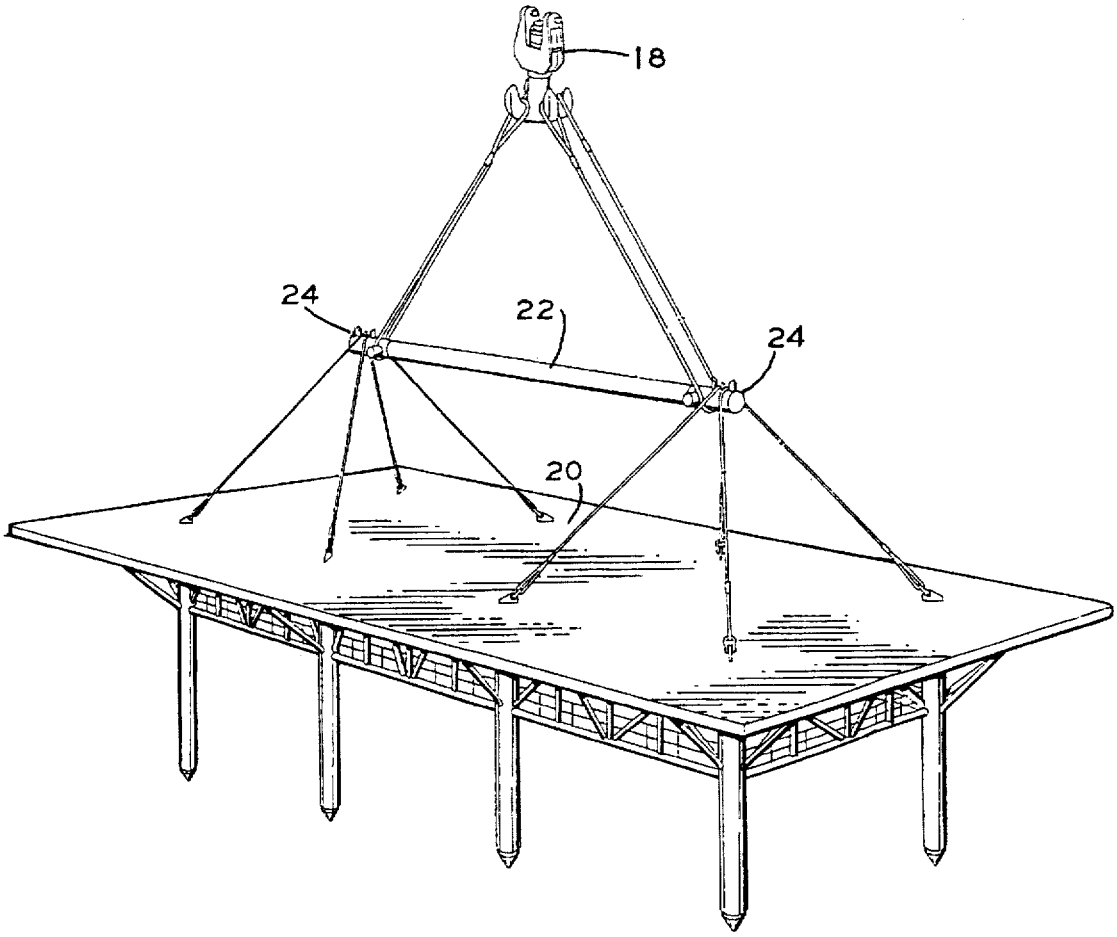
FIG. 3 illustrates a typical lift of an offshore structure using the invention with a spreader bar.

Two opposed pins 28, best seen in FIG. 6, extend radially from trunnion 24 adjacent its first end on either side of bore 26 and are perpendicular to the longitudinal axis of trunnion 24. Opposed pins 28 are in a substantially horizontal plane when the invention is in its working position as seen in FIG. 3. Pins 28 are rigidly fixed to trunnion 24.

A first pin 30 extends radially from adjacent the second end of trunnion 24, is perpendicular to the longitudinal axis of trunnion end 24, and is positioned so as to be in a plane that is orthogonal to opposed pins 28. First pin 30 is in a substantially vertical plane when the invention is in its working position as seen in FIG. 3. First pin 30 is rigidly fixed to trunnion 24.

A second pin 32 extends radially from trunnion 24 in the same plane as and is spaced apart from first pin 30 a sufficient distance to allow lifting slings 16 to be received between pins 30 and 32. Second pin 32 is spaced apart from opposed pins 28 toward the second end of trunnion 24 to allow sufficient space for the sling received from the crane hook 18. Pins 30 and 32 preferably have their upper ends beveled to help guide the slings between the pins. Second pin 32 is rigidly fixed to trunnion 24.

A third pin 34, which extends radially from trunnion 24 in the same plane as first and second pins 30, 32, may be placed between the first and second pins. This helps to prevent interference between the two slings received between the first and second pins. Third pin 34 is rigidly fixed to trunnion 24.

In operation, the spreader bar is sized according to the size and weight of the lift. The invention is installed on each end of the spreader bar. The slings that are looped over the crane hook are wrapped under the trunnion 24 and positioned against opposed pins 28. The slings that are attached to the deck unit 20 to be lifted are wrapped over the trunnion 24 between pins 30 and 32. It can be seen that the invention allows the use of slings that are less complicated to rig than those in the prior art. Although each sling still has a loop rigged at each end, double length slings are used which cuts the number of loops to be made in half. The elimination of the need for shackles on the lifting spreader and trunnion also reduces complexity and expense. Unlike the prior art where the slings are attached to the lift spreader, the present invention allows the slings to move across the trunnion to reduce the likelihood that an adverse shift in the angle of the lifting slings may occur. Although illustrated installed on a spreader bar 22, it should be understood that the trunnion end 24 may also be used at each corner of a spreader frame.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. A trunnion connection for use with a lifting spreader, comprising:

a. a tubular body having a first and second end and being adapted at the first end to be received on the lifting spreader;

b. two opposed pins that extend radially from said body adjacent the first end of said body;

c. a first pin that extends radially from said body adjacent the second end of said body and in a plane orthogonal to said opposed pins;

d. a second pin that extends radially from said body in the same plane as said first pin and spaced apart from said first pin; and e. a third pin extending radially from said body in the same plane as said first and second pins and spaced between said first and second pins.

* * * * *